US011041296B2

(12) United States Patent
Ethier

(10) Patent No.: US 11,041,296 B2
(45) Date of Patent: Jun. 22, 2021

(54) TOILET HAVING A BIDET SHOWER

(71) Applicant: Denis Ethier, Pierreville (CA)

(72) Inventor: Denis Ethier, Pierreville (CA)

( * ) Notice: Subject to any disclaimer, the term of this patent is extended or adjusted under 35 U.S.C. 154(b) by 0 days.

(21) Appl. No.: 16/430,665

(22) Filed: Jun. 4, 2019

(65) Prior Publication Data

US 2019/0368182 A1 Dec. 5, 2019

(30) Foreign Application Priority Data

Jun. 4, 2018 (GB) ..... 1809139

(51) Int. Cl.
*E03D 9/08* (2006.01)

(52) U.S. Cl.
CPC ..... *E03D 9/085* (2013.01)

(58) Field of Classification Search
CPC ..... E03D 9/085
USPC ..... 4/420.5, 420.4, 5
See application file for complete search history.

(56) References Cited

U.S. PATENT DOCUMENTS 3,995,326 A * 12/1976 Umann ..... E03D 9/08 4/420.1
4,287,618 A * 9/1981 Silver ..... E03D 9/085 4/420.2
4,998,300 A 3/1991 Sharifzadeh
5,063,618 A * 11/1991 Souka ..... E03D 9/08 4/420.4
5,272,774 A * 12/1993 Ivko ..... E03D 9/08 4/420.2
5,566,402 A 10/1996 Agha El-Rifai
5,572,748 A * 11/1996 Nee ..... E03D 9/08 4/420.2
5,943,707 A * 8/1999 Bergenwall ..... E03D 9/08 4/300.3
6,000,070 A 12/1999 Bonin
6,073,275 A * 6/2000 Klopocinski ..... E03D 9/052 4/213
6,105,178 A * 8/2000 Kurisaki ..... E03D 9/08 4/420.4
6,785,915 B1 * 9/2004 Daugherty ..... A61H 35/00 4/420.1
6,941,590 B2 * 9/2005 Lim ..... A47K 13/00 4/420.4
7,543,339 B1 * 6/2009 Harris ..... E03D 1/01 4/420.5
8,266,734 B2 * 9/2012 Allard ..... E03D 11/02 4/420.4
9,049,970 B2 * 6/2015 Dorra ..... A47K 13/302
2004/0074527 A1 * 4/2004 Sato ..... A47L 15/4278 134/113
2006/0265801 A1 * 11/2006 Riccobon ..... E03D 9/08 4/420.4

(Continued)

*Primary Examiner* — Lori L Baker

(57) ABSTRACT

An improved toilet having a bidet shower includes a head and a hose. The toilet includes a tank and a generally elongated bowl with a bowl opening. The hose passes from a back side of the tank to a front side of the tank via a passage defined between a cover and a reservoir of the tank. A protective panel removably mounted to one of the toilet seat and the bowl, the protective panel extending at least in part downwardly in the bowl opening. Advantageously, the seat cover conceals at least a portion of the head of the bidet shower when the toilet seat and the seat cover are in a closed position and the bidet shower is not in use.

10 Claims, 4 Drawing Sheets

(56) References Cited

U.S. PATENT DOCUMENTS

| | | | | |
|---|---|---|---|---|
| 2014/0047626 | A1* | 2/2014 | Dorra | A47K 13/302 4/223 |
| 2015/0059076 | A1* | 3/2015 | Tiagai | E03D 9/08 4/447 |
| 2018/0044903 | A1* | 2/2018 | Schwab | A47K 10/48 |

* cited by examiner

TOILET HAVING A BIDET SHOWER

CROSS-REFERENCE TO RELATED APPLICATIONS

The present application claims priority to United Kingdom Patent Application serial number 180939.7, filed on Jun. 4, 2019 entitled "Toilet having a bidet shower", the disclosure of which is hereby incorporated in its entirety at least by reference.

BACKGROUND OF THE INVENTION

1. Field of the Invention

The present invention relates to toilets and more particularly to a toilet having a bidet shower.

2. Description of Related Art

With the advent of modem toilets, different means have been developed for sanitary washing of the intimate parts after defecation and urination. Examples of such means include toilet paper, wet and gel wipes, cloths, and bidets.

While different people have different preferences with regard to sanitary washing, bidets have proved popular as they generally allow cleaning of intimate parts more thoroughly than with toilet paper and cloths.

Bidets are generally used to wash and clean the genitalia, perinium, inner buttocks and anus using a water jet, thus replacing or complementing the use of toilet paper.

Different bidet systems have been developed, including ceramic floor-mounted bidets, ceramic wall-mounted bidets, non-electric seat bidets and electric seat bidets.

Generally, bidet showers, also known as bidet sprays, bidet sprayer and health faucet, are used for anal cleansing and cleansing of the genitals after defecation and urination. Bidet showers generally consist in a hand-held triggered nozzle connected to an end of a hose for delivering a spray of water to assist cleansing.

However, ceramic bidets may require a lot of bathroom space, and may be costly, while electric bidets may also be costly and difficult to install.

While less costly, toilets with bidet showers may not always be aesthetically pleasing, as the hose may be visible and cumbersome, and may not always be practical to use, as the hose may be tangling, and necessitating the user to be in an uncomfortable position during sanitary washing.

U.S. Pat. No. 6,880,180, titled "Sanitary washing toilet seat device" by Hayashi et al. teaches a sanitary washing toilet device which includes a toilet seat, a toilet seat cover, and a case fixed to a rear top periphery portion of a toilet bowl. The case is rotatably connected with the toilet seat and the toilet seat cover. The sanitary washing toilet device further includes an optical sensor device provided on a front surface of the case for detecting an open and closed state of at least the toilet seat cover.

U.S. Pat. No. 6,941,590 titled "Toilet system attached a multi-purpose hand held sprayer" by Lim teaches an improved toilet system affording upgraded hygienic environment by attachment of a multi-purpose hand held sprayer and addition of new features on the existing toilet system ae provided. The multi-purpose hand held sprayer that incorporates a manual shut-off valve delivers various patterns of water spray via an extension bar and a spray tip, which further employs a flexible hose, a valve to regulate the flow, a Y-adapter assembly to supply water from an existing plumbing fixture, a hose hanger mounted on the existing toilet fasteners, a holder for placing the sprayer, and a holder for placing lavatory items. The new features include an improved toilet seat having an additional opening with guidelines and an embedded fortifying element at the frontal area for facilitating placement of the sprayer, a toilet bowl having the same guidelines, and an improved water tank together with its lid having cutouts at the edges and holes on the side wall for mounting the holders.

U.S. Pat. No. 7,055,185 titled "Antiseptic bidet in combination with a hygiene sty guard" by Deveer teaches an effective hygiene device that enables easy installation to the toilet bowls of most households. It is comprised of a high pressure, adjustable water stream and an antiseptic spray. A built in Hygiene Safety Guard enables a safety margin against the male penis being the toilet bowl. This invention easily installs onto toilet bowls found in most households. It also requires no connection to the water supply in the household. This invention may reduce infections that may be afflicting children, adults, and the elderly, who may find toilet paper difficult to use. There are many serious diseases associated with human excrement, and the antiseptic spray feature of this invention may reduce the risk of many infections. This invention also leads to a higher quality of life and a greater feeling of cleanliness.

Therefore, there is a desire for a toilet having a bidet shower that is convenient to use, hygienic, and allows hiding the bidet shower at least partially when not in use.

BRIEF SUMMARY OF THE INVENTION

It is an object of the present invention to alleviate at least some of the in conveniences present in the prior art. The present invention provides a toilet having a bidet shower having a head and a hose, a base, a bowl mounted on the base, a tank mounted on a rear portion of the base, a toilet seat and a toilet seat cover. The toilet has a generally elongated bowl with a bowl opening, a toilet seat cover pivotally connected to at least a portion of the tank about a rotational axis that is located above the base, the hose passing from a back side of the tank to a front side of the tank via a passage defined between a cover and the tank. The toilet may further include a protective panel removably mounted to one of the toilet seat and the bowl, the protective panel extending at least in part downwardly in the bowl opening, and the toilet seat may have a first connecting arm and a second connecting arm pivotally connecting the toilet seat to the one of the bowl and the tank, the first connecting arm and the second connecting arm defining a recess structured and dimensioned for receiving a human hand holding a head of the bidet shower. One broad aspect of the present technology provides a toilet comprising: a bidet shower for connection to a water source, a base, a bowl mounted on the base, the bowl defining a bowl opening, a tank mounted on a rear portion of the base, and a toilet seat pivotally connected to one of the bowl and the tank about an axis of rotation. The toilet seat defining a toilet seat opening, and a protective panel removably mounted to one of the toilet seat and the bowl, the protective panel extending at least in part downwardly in the bowl opening and separating the bowl opening into a front section and a back section.

In some embodiments the bidet shower includes a hose and a shower head connected to an end of the hose, the tank comprises: a cover disposed on top of the tank, and the hose passes from a back side of the tank to a front side of the tank via a passage defined between the cover and the tank. In some embodiments, the protective panel extending at least in part downwardly in the bowl opening defines a generally vertical wall. In some embodiments, the protective panel is removably mounted to the toilet seat and extends at least in part downwardly in the toilet seat opening. In some embodiments, the toilet seat comprises: a first connecting arm and a second connecting arm pivotally connecting the toilet seat to the one of the bowl and the tank about the axis of rotation, and the first connecting arm and the second connecting arm defining a recess structured and dimensioned for receiving a human hand holding a head of the bidet shower, the recess being of least partially aligned with the bowl opening when the toilet seat is in a closed position. In some embodiments, the tank comprises a first rib located on one side of the tank and a second rib located on another side of the tank, and the first connecting arm and the second connecting arm being pivotally connected to the first rib and the second rib respectively about the axis of rotation. In some embodiments, the axis of rotation is a first axis of rotation, and the toilet further comprises a seat covey being selectively disposed on top of the toilet seat, the seat cover being pivotally connected to the first rib and the second rib about a second axis of rotation, the second axis of rotation being located above the first axis of rotation of the toilet seat. In some embodiments, the seat cover conceals at least a portion of the head of the bidet shower when the toilet seat and the seat cover are in a closed position and the bidet shower is not in use. In some embodiments, the recess of the toilet seat is structured and dimensioned to receive the protective panel when the protective panel is not mounted to the one of: the toilet seat and the bowl. In some embodiments, the bowl and the base are integrally formed. In some embodiments, the bowl is generally elongated along a longitudinal axis. In some embodiments, the toilet further comprises a faucet connected to one of the bowl and the tank, and wherein the bidet shower is connected to the faucet.

A second broad aspect of the present technology provides a toilet comprising: a bidet shower for connection to a water source, the bidet shower including a hose and a shower head connected to an end of the hose, a base, a bowl mounted on the base, the bowl defining a bowl opening, a tank mounted on a rear portion of the base, the tank including a cover disposed on top of the tank, and a toilet seat pivotally connected to one of the bowl and the tank about an axis of rotation, the toilet seat defining a toilet seat opening, and the hose passes from a back aide of the tank to a front side of the tank via a passage defined between the cover and the tank.

In some embodiments, the toilet further comprises: a protective panel removably mounted to one of the toilet seat and the bowl, the protective panel extending at least in part downwardly in the bowl opening and separating the bowl opening into a front section and a back section. In some embodiments, the protective panel extending at least in part downwardly in the bowl opening defines a generally vertical wall. In some embodiments, the protective panel is removably mounted to the toilet seat and extends at least in part downwardly in the toilet seat opening. In some embodiments, the toilet seat comprises: a first connecting arm and a second connecting arm pivotally connecting the toilet seat to the one of the bowl and the tank about the axis of rotation, and the first connecting arm and the second connecting arm defining a recess structured and dimensioned for receiving a human hand holding the head of the bidet shower, the recess being at least partially aligned with the bowl opening when the toilet seat is in a closed position. In some embodiments, the tank comprises a first rib located on one side of the tank and a second rib located on another side of the tank. In some embodiments, the axis of rotation is a first-axis of rotation, and the toilet further comprises a seat cover being selectively disposed on top of the toilet seat, the seat cover being pivotally connected to the first rib and the second rib about a second axis of rotation, the second axis of rotation being located above the first axis of rotation of the toilet seat. In some embodiments, the seat cover conceals at least a portion of the head of the bidet shower when the toilet seat and the seat cover are in a closed position and the bidet shower is not in use. In some embodiments, the recess of the toilet seat is structured and dimensioned to receive the protective panel when the protective panel is not mounted to the one of: the toilet seat and the bowl. In some embodiments, the bowl and the base are integrally formed. In some embodiments, the bowl is generally elongated along a longitudinal axis. In some embodiments, the toilet further comprises a faucet connected to one of the bowl and the tank, and wherein the bidet shower is connected to the faucet.

A third broad aspect of the present technology provides a toilet comprising: bidet shower for connection to a water source, a base, a bowl mounted on the base, the bowl defining a bowl opening, a tank mounted on a rear portion of the base, and a toilet seat pivotally connected to one of the bowl and the tank about an axis of rotation, the toilet seat defining a toilet seat opening, the toilet seat comprising: a first connecting arm and a second connecting arm pivotally connecting the toilet seat to the one of the bowl and the tank about the axis of rotation, and the first connecting arm and the second connecting arm defining a recess structured and dimensioned for receiving a human hand holding a head of the bidet shower, the recess being at least partially aligned with the bowl opening when the toilet seat is in a closed position the first connecting arm and the second connecting arm being pivotally connected to the first rib and the second rib respectively about the axis of rotation.

In some embodiments, the bidet shower includes a hose and a shower head connected of an end of the hose, the tank comprises: a tank, and a cover disposed on top of the tank, and the hose passes from a back side of the tank to a front side of the tank via a passage defined between the cover and the tank. In some embodiments, the toilet further comprises a protective panel removably mounted to one of the toilet seat and the bowl, the protective panel extending at least in part downwardly in the bowl opening and separating the bowl opening into a front section and a back section. In some embodiments, the protective panel extending at least in part downwardly in the bowl opening defines a generally vertical wall. In some embodiments, the protective panel is removably mounted to the toilet seat and extends at least in part downwardly in the toilet seat opening. In some embodiments, the tank comprises a first rib located on one side of the tank and a second rib located on another side of the tank, and the first connecting arm and the second connecting arm being pivotally connected to the first rib and the second rib respectively about the axis of rotation. In some embodiments, the axis of rotation is a first axis of rotation, and the toilet further comprises a seat cover being selectively disposed on top of the toilet seat, the eat cover being pivotally connected to the first rib and the second rib about a second axis of rotation, the second axis of rotation being located above the first axis of rotation of the toilet. In some embodiments, the seat cover conceals at least a portion of the head of the bidet shower when the toilet seat and the seat cover are in a closed position and the bidet shower is not in use. In some embodiments, the recess of the toilet seat is structured and dimensioned to receive the protective panel when the protective panel is not mounted to the one of: the toilet seat and the bowl. In some embodiments, the bowl and the base are integrally formed. In some embodiments, the bowl is generally elongated along a longitudinal axis. In some embodiments, the toilet further comprises a faucet connected to one of the bowl and the tank, and wherein the bidet shower is connected to the faucet. In some embodiments there are two faucets located at the front of the elongated bowl and connected to the bidet shower wherein one faucet controls the flow of hot water and the other faucet controls the flow of cold water flow of the bidet shower.

Additional and/or alternative objects, features, and advantages of the embodiments of the present invention will become apparent from the following description, the accompanying drawings, and the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
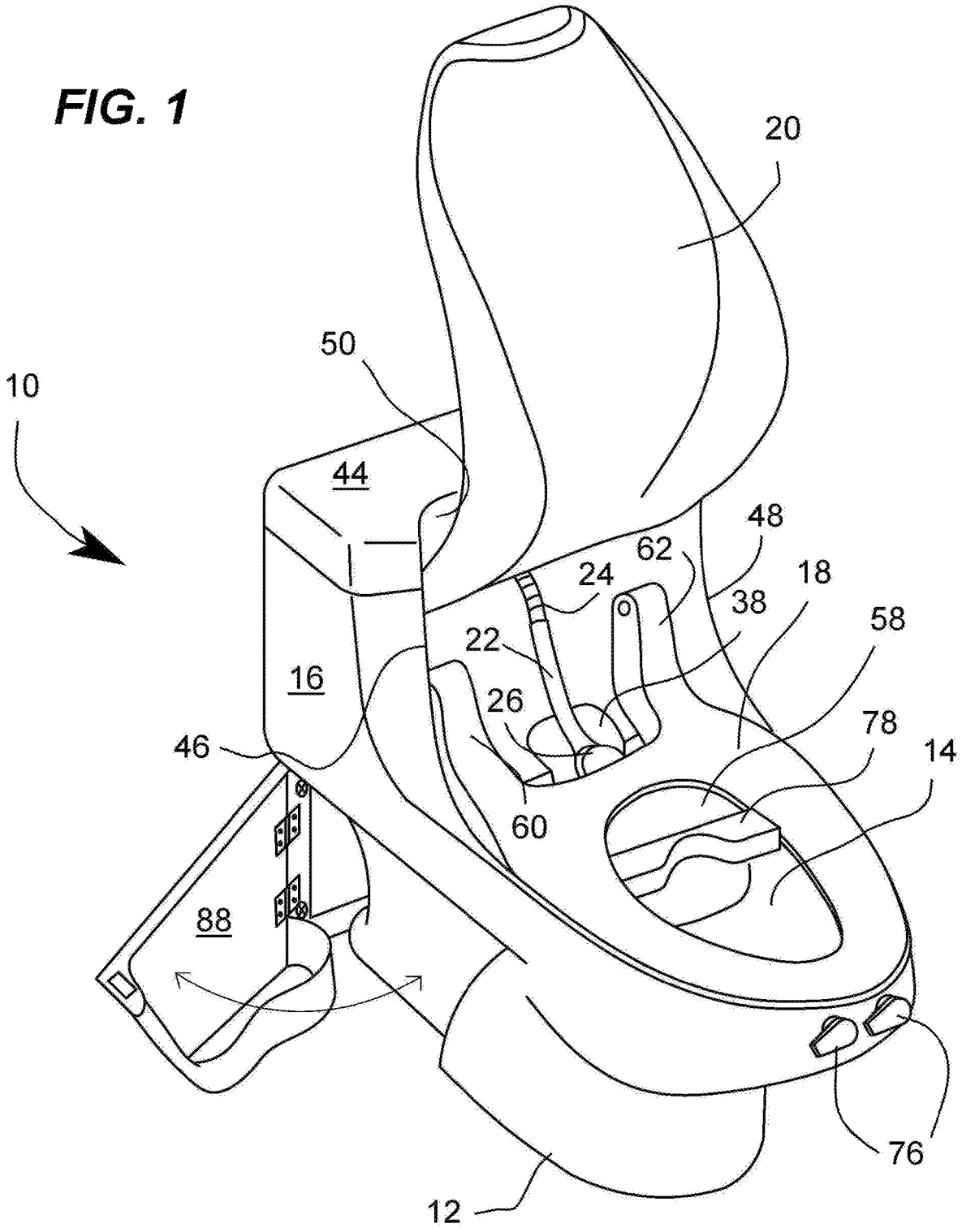
FIG. 1 is a perspective view of a toilet having a bidet shower according to an embodiment of the present invention.
Figure 2:
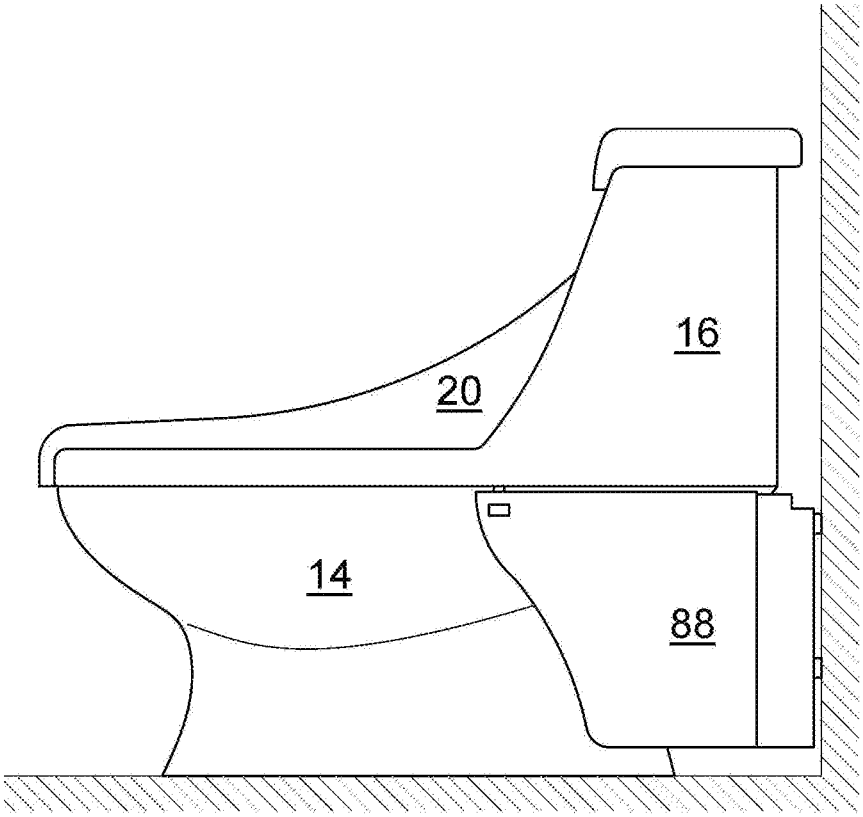
FIG. 2 is a-right side view of the toilet having a bidet shower according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a toilet having a bidet shower.

Referring now to FIGS. 1-4, a toilet 10 having a bidet shower 22 is Illustrated. In one embodiment, the toilet comprises a base 12, a bowl 14, a tank 16, a toilet seat 18, a toilet neat cover 20, and the bidet shower 22. In one embodiment, the bidet shower 22 includes a hose 24 and head 26 connected to an end of the hose. The base is positioned directly over the floor and fixed to the floor via mounting nuts as well known in the art. In one embodiment, the bowl 14 and the base 12 are integrally formed. Preferably, the bowl 14 is generally elongated along a longitudinal axis more so than toilet bowls of the prior art. This will be explained in greater detail below.

In one embodiment, a rear portion of the bowl 14 enables a hand 34 of a user 36 holding the head 26 of the bidet shower 22 to pass in a recess 38 of the toilet seat 18. This will be explained in greater detail below.

In one embodiment, the tank 16 includes a cover 44, a left rib 46, and a right rib 48. The tank is mounted to a rear portion of the base 12. In one embodiment, the left rib 46 is positioned on the left side of the tank 16 extending towards the bowl 14. Similarly, the right rib 48 is positioned on the right side of the tank extending toward the bowl 14. The left rib 46 is parallel to the right rib 48 and defines a concave curve such that the head 26 and the hose 24 of the bidet shower 22 fit at least partially between the left rib 46 and the right rib 48. Advantageously, the concave curve allows the toilet seat cover 20 to fit at least partially between the left and right ribs 46, 48 when the toilet seat cover is in an open position.

In some embodiments, there is a tank recess 50 on the front side of the tank 16 within the concave curve where the bidet shower 22 is positioned such that it does not interfere with the rising and lowering of the toilet seat 20. Further, this arrangement hides the bidet shower when the toilet seat 20 is in a closed positioned.

As expected, the seat over 20 is enabled to pivot from an open to a closed position. In order to do so, the left rib 46 has a left seat cover aperture (not shown) and the right rib 48 has a right seat cover aperture (not shown), wherein both apertures are about a first rotational axis so that pins (not shown) extending integrally from the toilet seat cover 20 can engage in the apertures allowing the seat cover 20 to pivot between the open and closed position.

Figure 3:
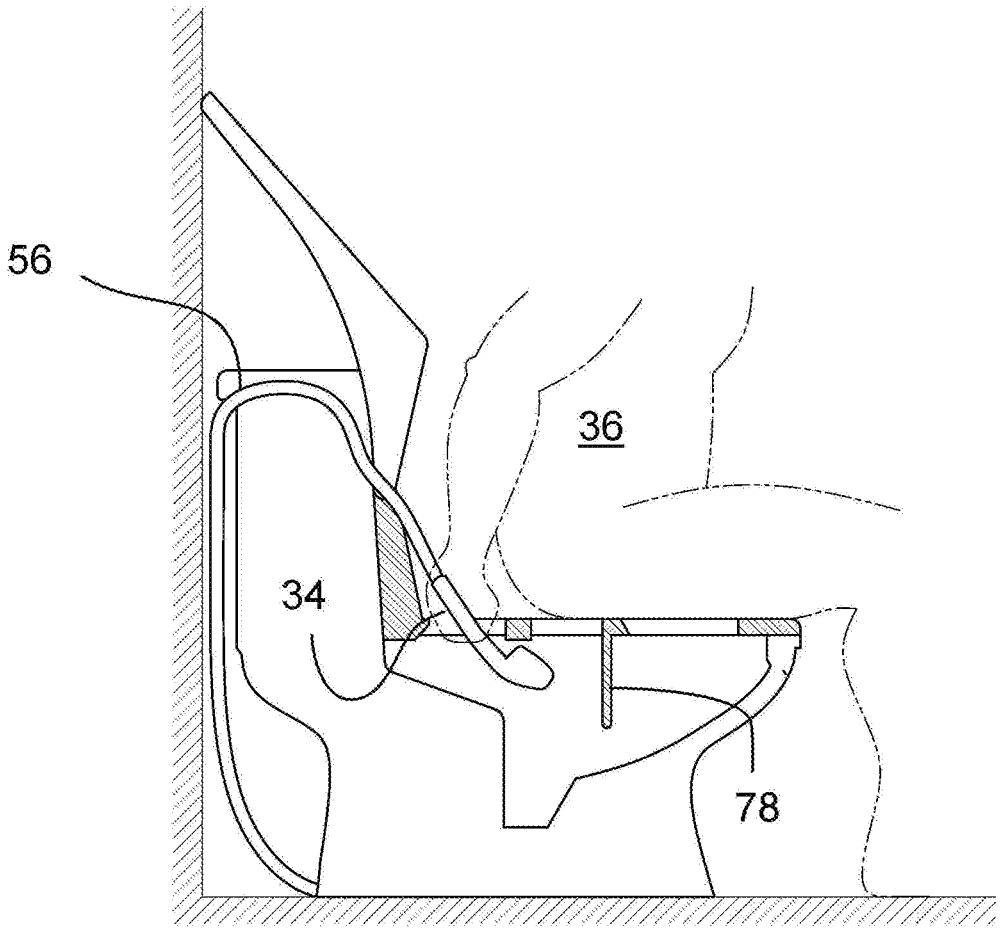
FIG. 3 is a left side cutway view of the toilet having a bidet shower in use according to an embodiment of the present invention; and, FIGS. 4A-B are top and front views of a storage compartment of the toilet a according to an embodiment of the present invention.
Figure 4A:
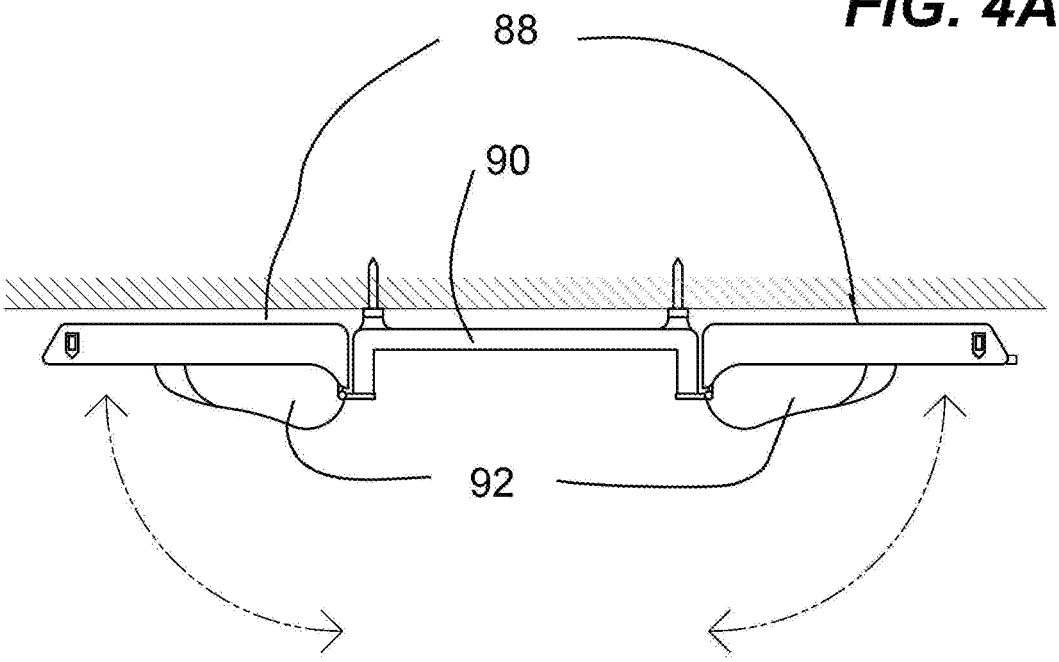
Figure 4B:
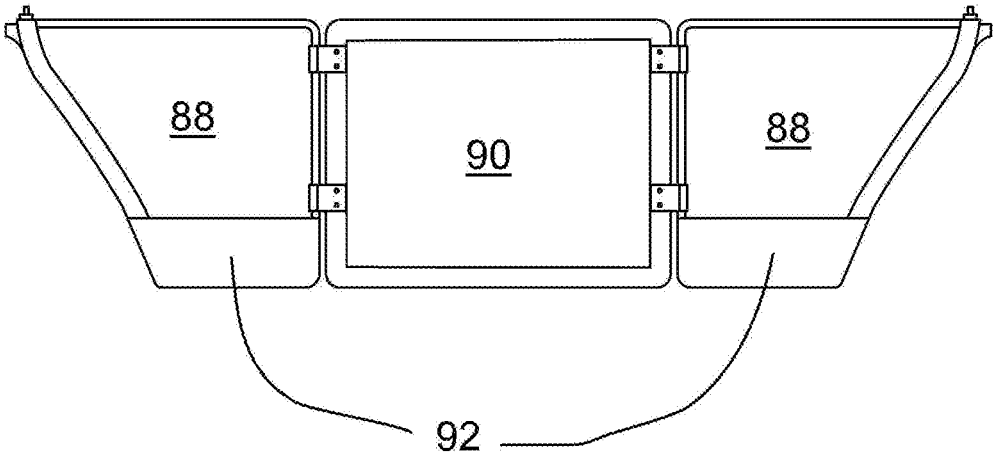

Best seen in FIG. 3, the hose 24 of the bidet shower 22 passes fro a back side of the tank 16 to a front side of the tank 16 via a passage 56 located between the tank cover 44 and the tank 16. In some embodiment, the cover 44 may be disposed an top of the tank 16 via spacers located on the left side and the right side of the tank to create the passage 56. Advantageously, the hose 24 is enabled to slide freely in the passage 56 allowing a user 36 to use the bidet shower 22. Specifically, by moving the shower head 26 from a retracted position in positioned in recess 38 to an in use position as illustrated in FIG. 3. Generally, the weight of the hose 24 behind the tank 16 helps in retracting back the bidet shower 22 back into the recess 38 when not in use.

In one embodiment, the toilet seat 18 includes a toilet seat opening 59, a first connecting arm 60, and a second connecting arm 62, wherein the connecting arms are for pivotally connecting the toilet seat 18 to the tank 16.

As previously mentioned, the toilet bow 14 is elongated more than toilets of the prior art. For instance, the bowl 14 is approximately 6 inches (15 cm) longer compared to a prior art standard bowl which allows for a user to pit more forwardly on the toilet seat 18 so as to have room for a hand 34 from a user 36 to grab the bidet shower 22 and use it.

In one embodiment, the flow of the bidet shower 22 is controlled by two faucets 76 located at the front of the bowl 14 to control the flow of hot and cold water. It should be understood that the location of the faucets may vary based on convenience or ease of operation.

In some embodiments, a pair of flap doors 88 is provided forming part of the bottom rear of the toilet 10 acting as storage compartments 92. Each flap 88 is attached to a back pane 90 which can be mechanically fastened to a wall behind the toilet 10. Another function is to streamline the rear portion of the base 12 so that it is easier to clean and as such, more sanitary.

In one embodiment, advantageously, a protective partition 78 is provided, wherein the protective partition fits inside the bowl 14 preventing the bidet shower from spraying outside of the bowl, as well as limiting the amount of water being sprayed on the user 36.

The best mode of use will now be described. First, assuming the toilet seat cover 20 is in a closed position, the user 36 lifts the toilet seat cover 20 to an opened position. Next, the user 36 sits on the toilet seat 18 and defecates in the bowl receptacle 30 through the bowl opening 28 as well known in the art. Next, the user 36 takes the protective partition 78 stored in the panels and mounts it to the bowl 14. Then, the user 36 picks up the bidet shower 22 with his hand 34 and passes it through the recess 38 and under the toilet seat 18. The user 36 then activates the cold and hot water taps 76 located on the front of the bowl 14 such that water flows from the head 26 and the user 36 directs the water spray toward the inner buttocks and anus. Advantageously, the protective partition 78 at least partially protects the intimate parts of the user 36 from the water spray and spatter of water and waste from the bowl receptacle 30. Next, the user 36 repositions the head 26 of the bidet shower 22 on the rear portion of the base 12 and behind the first rotational axis of the toilet seat cover 20. Next, the user 36 dries himself or herself as well known in the art. Optionally, the user 36 may remove and clean the protective partition 78, and store it in the recess compartment 66. Finally, the user places the toilet seat cover 20 in a closed position.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alterative embodiments will occur to those skilled in the art. Such variations and alternate embodiments are contemplated, and can be made without departing from the spirit and scope of the invention.

It should further be noted that throughout the entire disclosure, the labels such as left right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to"first," "second," "third," and etc. members throughout the disclosure (and in particular, claims) are not used to show a serial or numerical limitation but instead are used to distinguish or identify the various members of the group.

What is claimed is:

1. A toilet comprising:

a base;

a tank;

an elongated bowl mounted on the base, the elongated bowl defining an opening;

a toilet seat pivotally and hingedly connected to the base or the elongated bowl such that the toilet seat is configured to pivot between a first closed position and a first opened position, wherein the first closed position is defined when the toilet seat rests on the elongated bowl;

a shaped toilet seat cover pivotally and hingedly connected to the base or the tank such that the toilet seat cover is configured to pivot between a second closed position and a second opened position; an anti-splash protective partition panel;

a recess formed on a rear portion of the toilet seat, wherein the recess is configured to receive a movable bidet shower, wherein the movable bidet shower comprises a flexible and extendible hose and shower head;

the toilet seat includes a first connecting arm and a second connecting arm extending from the rear portion of the toilet seat defining the recess; and;

the tank includes a left rib and a right rib configured to pivotally receive the first connecting arm and a second connecting arm respectively such that the toilet seat is configured to pivot in a first axis of rotation.

2. The toilet of claim 1, wherein the toilet seat cover is configured to pivotally connect to the left and right rib in a second axis of rotation, wherein the second axis of rotation is above the first axis of rotation.

3. The toilet of claim 1, wherein the toilet seat cover is configured to conceal at least a portion of the shower head when the toilet seat and the toilet seat cover is in the first closed position and the second closed portion respectively.

4. The toilet of claim 1, further comprising said protective partition configured to be removably mourned to the toilet seat or the elongated bowl, wherein the protective partition extends downwardly in the opening such that the protective partition prevents the shower head from spraying outside the opening of the elongated bowl.

5. The toilet of claim 4, further comprising storage compartments configured to store the protective partition when not in use.

6. The toilet of claim 1, wherein the base and the elongated bowl are integrally formed.

7. The toilet of claim 1, wherein the tank includes a cover and a passage wherein the passage enables the hose to slide freely.

8. The toilet of claim 1, further comprising a faucet connected to the elongated bowl or tank, wherein the bidet shower is connected to the faucet.

9. The toilet of claim 1, wherein the rear portion enables a hand of a user to hold and operate the bidet shower.

10. The toilet of claim 1, further comprised of two faucets located at the front of the elongated bowl and connected to the bidet shower wherein one faucet controls the flow of hot water and the other faucet controls the flow of cold water flow of the bidet shower.

* * * * *